US006712738B2

(12) United States Patent
Siek

(10) Patent No.: US 6,712,738 B2
(45) Date of Patent: Mar. 30, 2004

(54) HAND EXERCISER

(75) Inventor: Jason L. Siek, Bedford, OH (US)

(73) Assignee: Jason Siek, Bedford, OH (US)

( * ) Notice: Subject to any disclaimer, the term of this patent is extended or adjusted under 35 U.S.C. 154(b) by 153 days.

(21) Appl. No.: 10/117,799

(22) Filed: Apr. 3, 2002

(65) Prior Publication Data

US 2003/0190997 A1 Oct. 9, 2003

(51) Int. Cl.[7] ..... A63B 23/16

(52) U.S. Cl. ..... 482/44; 482/131; 482/907

(58) Field of Search ..... 482/44–50, 91, 482/92, 121, 127, 148, 907, 131; 601/40; 602/21, 22; 473/40; 84/465, 467

(56) References Cited

U.S. PATENT DOCUMENTS

| | | | | | |
|---|---|---|---|---|---|
| 117,791 | A | * | 8/1871 | Marks | 601/40 |
| 130,457 | A | * | 8/1872 | Wenzel | 482/47 |
| 806,681 | A | | 12/1905 | Kursheedt | |
| 1,174,205 | A | | 3/1916 | Underwood | |
| 1,256,004 | A | * | 2/1918 | Finney | 482/48 |
| 3,051,482 | A | * | 8/1962 | Harpham | 482/110 |
| 3,612,521 | A | | 10/1971 | Wendeborn | |
| 3,724,314 | A | | 4/1973 | Columbo | |
| 3,756,222 | A | | 9/1973 | Ketchum | |
| 3,937,215 | A | | 2/1976 | Barthlome | |
| 4,615,522 | A | | 10/1986 | Plough | |
| 4,730,827 | A | | 3/1988 | Williams | |
| 4,822,027 | A | * | 4/1989 | Kascak | 482/46 |
| 4,961,568 | A | | 10/1990 | Clark et al. | |
| 5,072,927 | A | * | 12/1991 | Santos | 482/44 |
| 5,136,911 | A | | 8/1992 | Wyss | |
| D350,997 | S | * | 9/1994 | Connelly, III | 482/121 |
| 5,833,588 | A | * | 11/1998 | Connelly III et al. | 482/121 |
| 5,916,032 | A | * | 6/1999 | Stoll | 473/40 |
| 6,186,860 | B1 | * | 2/2001 | Liao | 482/44 |
| 2002/0147074 | A1 | * | 10/2002 | Eikanas | 482/44 |

FOREIGN PATENT DOCUMENTS

| | | | | | |
|---|---|---|---|---|---|
| DE | 3222774 | A1 | * | 12/1983 | |
| FR | 378255 | | * | 5/1907 | 482/47 |
| GB | 167484 | | * | 1/1922 | 482/47 |
| JP | 406023068 | A | * | 2/1994 | 482/49 |
| RU | 2015707 | C1 | * | 7/1994 | 482/48 |
| RU | 2015708 | C1 | * | 7/1994 | 482/44 |

* cited by examiner

*Primary Examiner*—Nicholas D. Lucchesi
*Assistant Examiner*—Victor Hwang

(57) ABSTRACT

A readily applicable exercise device is provided constructed of four hinge-like or living hinge devices and four generally shaped blocks. Each said block has a rounded groove in the center for finger placement and grip. This design allows the fingers, placed on opposite sides of the machine, to be stretched equally on both sides and in a number of different variations to focus on specific muscles or tendons within the fingers and hand.

4 Claims, 2 Drawing Sheets

HAND EXERCISER

BRIEF SUMMARY OF THE INVENTION

This invention relates to an exercising instrument useful in preparing the hand and fingers for strenuous, tedious or everyday use. In construction and capability the device also lends itself instrumental to the field of physical therapy to rehabilitate damaged muscles or tendons in the hand or fingers. The device of this invention would be advantageous to many different professions including baseball pitchers, computer users, skilled manual artists, therapists, musicians or any persons that would benefit from having stronger and more flexible hands and fingers. All users from beginner to advanced would equally gain from this machine. When applied consistently along with normal activities maximum results will be achieved faster and easier.

The primary object of the invention is to provide a device to be used in a manner as to manipulate the skin, knuckle joints, tendons and muscles of the hand and fingers. This allows the maintenance of an unnaturally extended position in which said hand and fingers are forcibly stretched beyond normal and natural limits in order to extend said limits. Over time the user will gradually increase lateral reach, improve agility and develop independence between fingers. It is intended to be broadly constructed and the design in general is subordinate to the net effect of the device herein described as a hand exerciser.

PRIOR ART

Prior patents have introduced numerous advantageous machines in the field of therapeutics and rehabilitation to enhance overall strength within the hand, or as an aid in cases of damaged tendons and their related muscles. Despite the numerous positive applications of such devices they have been restricted to either extremely complex and impractical systems or limited efficiency. Some previous machines designed to benefit hand development and digital dexterity requires time to apply and adjust the device such as U.S. Pat. No. 806,861 of Kursheedt, and U.S. Pat. No. 1,174,205 of Underwood, while others need a secondary item such as a guitar or keyboard to properly use. Columbo U.S. Pat. No. 3,724,314 is an example. What is clearly lacking in the above-described prior art is an easy to use appliance to prepare the hand and fingers for exertion. Such a device should stretch the muscles in the fingers and hand and, at the same time, increase muscular strength by repeated use. The design should also be lightweight, compact and yield the option to use at any time and place.

DRAWINGS

DETAILED DESCRIPTION OF THE INVENTION

Figure 1:
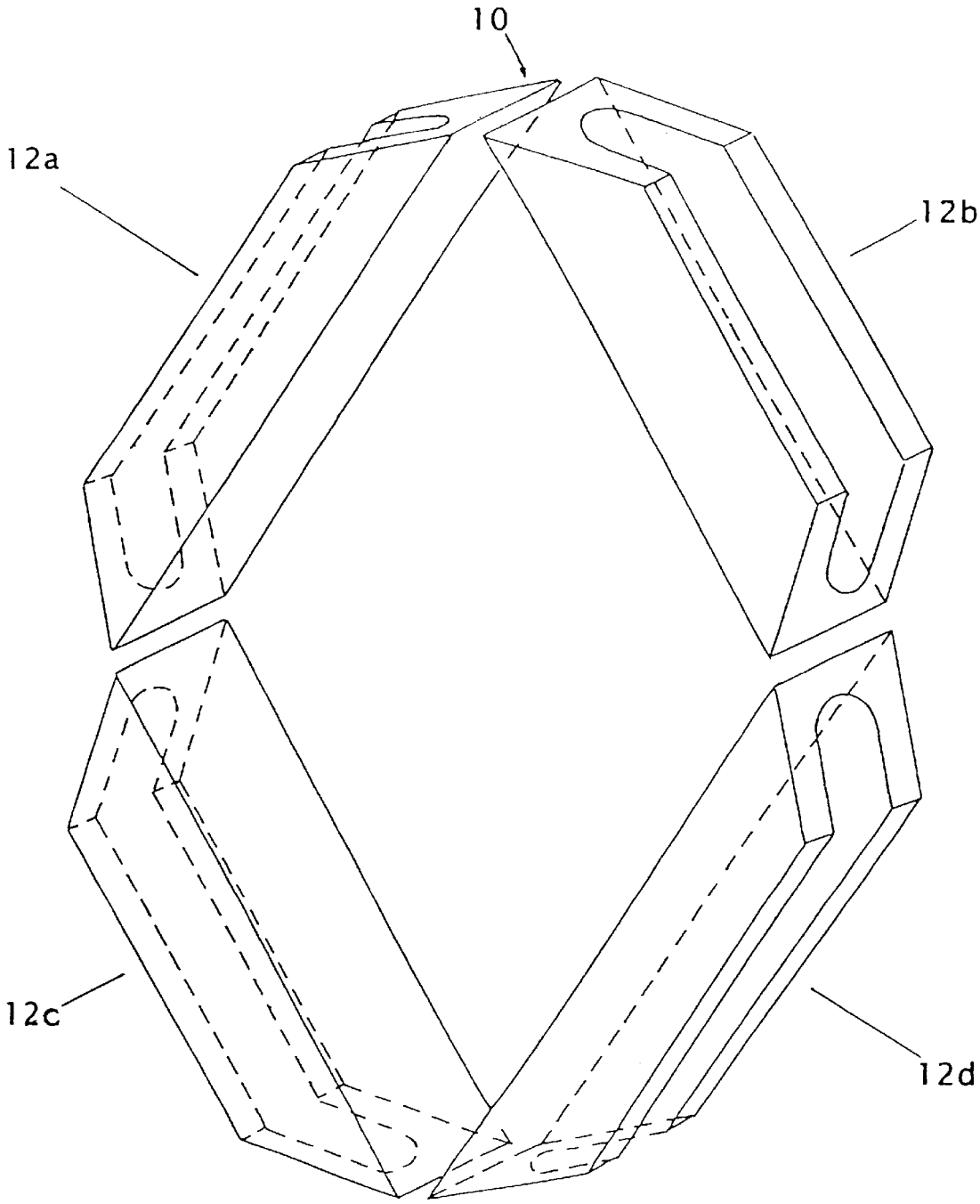
FIG. 1 is a perspective view of the preferred embodiment.

For purposes of promoting an understanding of the principles of the invention, reference will now be made to the embodiments illustrated in the drawings and specific language will be used to describe same. It will be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

Figure 2:
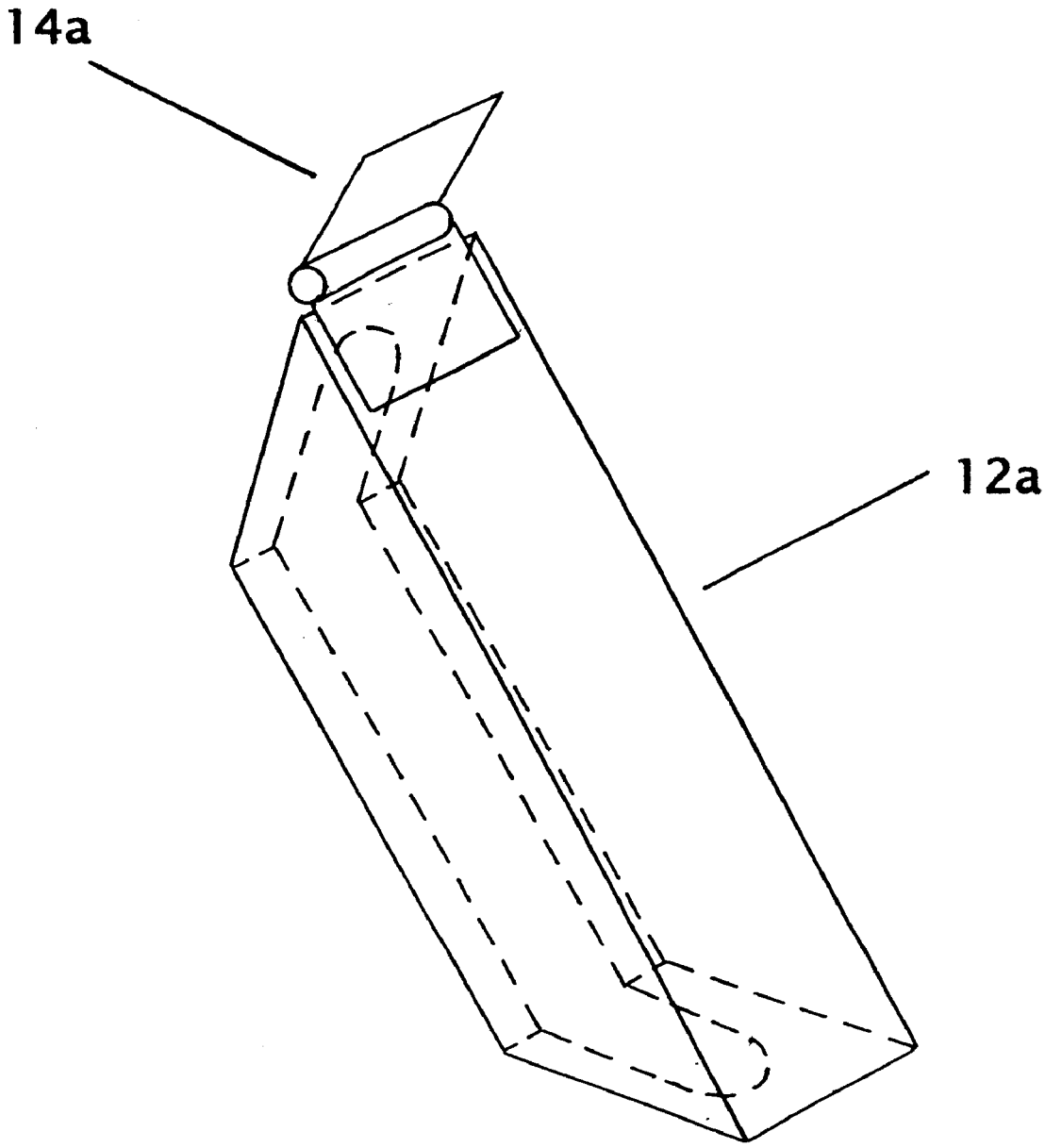
FIG. 2 is a perspective view of one of the four identical segments illustrating how hinge and block connect.

For easier description related figures have the same number but different alphabetical suffixes and like reference characters denote like elements throughout the several views. A device (10) constructed primarily of four grooved blocks (12*a, b, c, d*) fabricated from a sturdy material is shown in FIG. 1. For clarity the view of the preferred embodiment in FIG. 1 does not include the four hinge-like appliances or living hinges that interlock the four blocks. In FIG. 2 only one block or segment is shown detailing the manner in which the hinge-like appliance or living hinge is attached to the block. This same assembly is used on all four segments, thus connecting all parts to one another. The hinge-like appliance or living hinge acts as an axis to which said blocks pivot increasing lateral distance between them.

In use the exerciser (10) is held in one hand by firmly grasping two blocks so the hinge-like appliance or living hinge connecting them is snug firmly in the palm. All sides are identical so for purpose of example assume in general use blocks 12*a* and 12*b* are gripped in the right hand to exercise the left hand. The hinge-like appliance or living hinge connecting blocks 12*a* and 12*b* should be fixed in the palm of the right hand with the thumb on block 12*a* and the pinky finger on block 12*b*. The index, middle, and ring finger of the same hand should be on the opposite side for additional support. Now that the unit is secure in the right hand the user is ready to apply it to the left hand. Components 12*c* and 12*d* are placed between any two fingers on the left hand.

From this basic starting position the user has the option to either push up, down, out, or in a circular motion depending on the chosen area of concentration. Pushing out would focus on the area between the fingers. Pushing up would focus on the palm side of the hand. Pushing down would focus on the forehand side. A circular motion works all the areas in succession. Regardless of the direction or amount of pressure applied the distribution of force on both sides of the unit is constant and even.

As described above a number of different exercises can be used to target many of the muscles and tendons in the metacarpus region. One single unit performs on either hand. There is no need for adjustments to accommodate different size hands and fingers. With a maximum span of almost 180 degrees the limits of this device are almost unattainable. Ultimately an extension of the operable reach of the fingers and hand will be achieved. The following preferred embodiment is of simple design, and conceivable changes could be made to improve upon comfort or effectiveness.

References

| REFERENCES | | |
|---|---|---|
| 806,681 | December 1905 | Kursheedt |
| 1,174,205 | March 1916 | Underwood |
| 3,051,482 | January 1960 | Harpham |
| 3,612,521 | June 1969 | Wendeborn |
| 3,724,314 | April 1973 | Columbo |
| 3,756,222 | September 1973 | Ketchum |
| 3,937,215 | February 1976 | Barthlome |
| 4,615,522 | October 1986 | Plough |
| 4,730,827 | March 1988 | Williams |
| 4,961,568 | October 1990 | Clark |
| 5,136,911 | September 1992 | Wyss |
| D 350,997 | September 1994 | Connelly, III |

What is claimed is:

1. A handheld hand exercise instrument comprising:

a first finger block, a second finger block, a third finger block, and a fourth finger block, each finger block elongate in shape with first and second ends and having an inner side and an outer side;

a first hinge, a second hinge, a third hinge, and a fourth hinge, each hinge respectively connecting the first end of one of the finger blocks to the second end of another of the finger blocks so that the finger blocks are interlocked to one another and form a closed ring configuration, wherein the first finger block is generally diametric the third finger block and the second finger block is generally diametric the fourth finger block; and the outer side of each finger block having a groove sized for receiving the fingers or thumb of a user, wherein the user grasps the hand exercise instrument with a first hand with one of the hinges positioned in the palm of the first hand and respective finger blocks positioned adjacent the thumb and fingers of the first hand with the groove of one respective block receiving the thumb and the groove of the other respective block receiving the fingers, and the remaining finger blocks are engaged by the second hand of the user to apply a user applied force to either hand and fingers of the user.

2. The handheld hand exercise instrument of claim 1, wherein each said groove extends along the entire length of the respective outer side of each respective finger block.

3. The handheld hand exercise instrument of claim 1, wherein the first and second ends of each finger block is tapered.

4. The handheld hand exercise instrument of claim 1, wherein each hinge is connected to the inner sides of respective finger blocks.

* * * * *